US010385883B2

(12) United States Patent
Spohr

(10) Patent No.: US 10,385,883 B2
(45) Date of Patent: Aug. 20, 2019

(54) VIBRATING RAM ARRANGEMENT, AND METHOD FOR OPERATING THE VIBRATING RAM ARRANGEMENT

(71) Applicant: THYSSENKRUPP INFRASTRUCTURE GMBH, Essen (DE)

(72) Inventor: Jochen Spohr, Borken (DE)

(73) Assignee: THYSSENKRUPP INFRASTRUCTURE GMBH, Essen (DE)

( * ) Notice: Subject to any disclaimer, the term of this patent is extended or adjusted under 35 U.S.C. 154(b) by 437 days.

(21) Appl. No.: 14/783,313

(22) PCT Filed: Apr. 3, 2014

(86) PCT No.: PCT/EP2014/000888
§ 371 (c)(1),
(2) Date: Oct. 8, 2015

(87) PCT Pub. No.: WO2014/166608
PCT Pub. Date: Oct. 16, 2014

(65) Prior Publication Data

US 2016/0061227 A1 Mar. 3, 2016

(30) Foreign Application Priority Data

Apr. 12, 2013 (DE) ..... 10 2013 103 722

(51) Int. Cl.
*F15B 13/04* (2006.01)
*B06B 1/02* (2006.01)
(Continued)

(52) U.S. Cl.
CPC ..... *F15B 13/0401* (2013.01); *B06B 1/02* (2013.01); *E02D 7/18* (2013.01); *F15B 11/08* (2013.01);
(Continued)

(58) Field of Classification Search
CPC .... F15B 15/04; F15B 11/08; F15B 2211/405; F15B 2211/20546; F15B 2211/20523; F15B 2211/255; B06B 1/186; F02D 29/04
(Continued)

(56) References Cited

U.S. PATENT DOCUMENTS 2,161,439 A * 6/1939 Thoma ..... F16H 61/423 60/451
2,496,291 A * 2/1950 High ..... B06B 1/186 366/124
(Continued)

FOREIGN PATENT DOCUMENTS

DE 2236134 A1 2/1974
DE 2700803 A1 7/1978
(Continued)

OTHER PUBLICATIONS

German Language International Search Report for International patent application No. PCT/EP2014/000888; dated Jul. 28, 2014.
(Continued)

*Primary Examiner* — Thomas E Lazo
*Assistant Examiner* — Richard C Drake
(74) *Attorney, Agent, or Firm* — thyssenkrupp North America, Inc.

(57) ABSTRACT

The invention relates to a vibrating ram arrangement comprising a hydraulic assembly, a vibrator which is connected to the hydraulic assembly via hydraulic tubes, and a controller which is paired with the hydraulic assembly. The hydraulic assembly has a hydraulic pump which is driven by an internal combustion engine, and the vibrator has imbalances and an adjustable hydraulic engine for driving the imbalances. A hydraulic fluid is conducted through the hydraulic assembly, the hydraulic tubes, and the hydraulic
(Continued)

engine in a circuit. A frequency sensor for determining the frequency of the vibrator is connected to the controller, and the controller is designed to control a volumetric flow rate conducted through the circuit dependent on the signal of the frequency sensor. According to the invention, the vibrator has a device, which is independent of the controller, for automatically adjusting a displacement volume of the hydraulic engine dependent on a pressure within the circuit.

15 Claims, 2 Drawing Sheets

(51) Int. Cl.
*F15B 11/08* (2006.01)
*E02D 7/18* (2006.01)

(52) U.S. Cl.
CPC ..... *F15B 2211/20523* (2013.01); *F15B 2211/20546* (2013.01); *F15B 2211/255* (2013.01); *F15B 2211/405* (2013.01)

(58) Field of Classification Search
USPC ..... 60/490, 448, 445; 64/90, 48; 74/61
See application file for complete search history.

(56) References Cited

U.S. PATENT DOCUMENTS 3,670,631 A * 6/1972 Gaylor ..... B06B 1/162 404/117
3,807,174 A * 4/1974 Wagenseil ..... B62D 11/183 180/6.48
3,866,420 A 2/1975 Appel
3,866,693 A * 2/1975 Century ..... B25D 9/12 173/49
3,909,149 A * 9/1975 Century ..... E02D 3/074 173/162.1
4,040,254 A * 8/1977 Knapp ..... B62D 11/183 180/6.48
4,168,612 A * 9/1979 Nikolaus ..... B60W 10/06 60/431
4,399,886 A * 8/1983 Pollman ..... F16H 61/423 180/197
4,401,182 A * 8/1983 Pollman ..... F16H 61/439 180/197
4,616,716 A * 10/1986 Bouplon ..... B25D 11/06 173/49
4,739,616 A * 4/1988 Myers ..... F04B 49/08 60/420
5,984,572 A * 11/1999 Mitsui ..... B06B 1/164 404/117
6,105,685 A * 8/2000 Bald ..... B06B 1/186 173/2
6,322,240 B1 * 11/2001 Omasa ..... B01F 11/0082 366/118
7,089,823 B2 * 8/2006 Potts ..... E01C 19/288 404/117
7,201,245 B2 * 4/2007 Shrive ..... B60K 17/356 180/197
7,997,360 B2 * 8/2011 Smith ..... B62D 11/005 180/307
8,312,716 B2 11/2012 Deeken et al.
9,782,800 B2 * 10/2017 Renz ..... B06B 1/186
2009/0007559 A1 * 1/2009 Dazin ..... B06B 1/161 60/445
2010/0166499 A1 * 7/2010 Stenzel ..... B06B 1/186 404/133.05
2013/0036727 A1 2/2013 Heichel et al.
2013/0091833 A1 * 4/2013 Zhan ..... B60W 10/06 60/327
2014/0331660 A1 * 11/2014 Hata ..... E02F 9/2246 60/327
2017/0037790 A1 * 2/2017 Kim ..... E02F 9/2235

FOREIGN PATENT DOCUMENTS

DE 3806194 A1 8/1989
DE 202007014676 U1 2/2009
EP 0423704 B 1/1995
EP 2014835 A1 1/2009
EP 2085149 A 8/2009
EP 2557233 A1 2/2013

OTHER PUBLICATIONS

English translation of International Search Report for International patent application No. PCT/EP2014/000888; dated Jul. 28, 2014.
English translation of Abstract of DE 3806194 A1.
ThyssenKrupp GfT Bautechnik GmbH brochure titled "MULLER-vibrators. The ideal solution for driving and extracting.") dated May 2011.
H. Exner et al., Training and information book on the basics and components of fluid technology—hydraulics, Mannesman Rexroth (1991; accessed Jul. 10, 2017). [English translation and original attached].
Axial Piston Variable Motor A6VM—Technical data sheet, Rexroth Bosch Group, A6VM Re 91604/01.07, pp. 1-21 and 76 (Accessed Jul. 10, 2017). [English translation + original attached].
Mannesmann Rexroth: Der Hydraulik Trainer Bd. 1 Grundlagen and Komponenten der Fluidtechnik—Hydraulik, 2. Aufl. 1991 (Auszug: S. 108, 109 121). [Original attached. In process of locating English translation].

* cited by examiner

VIBRATING RAM ARRANGEMENT, AND METHOD FOR OPERATING THE VIBRATING RAM ARRANGEMENT

CROSS REFERENCE TO RELATED APPLICATIONS

This application is a U.S. National Stage Entry of International Patent Application Serial Number PCT/EP2014/000888, filed Apr. 3, 2014 which claims priority to German patent application no. DE 102013103722.4, filed Apr. 12, 2013, the entire contents of both of which are incorporated herein by reference.

FIELD

The present disclosure relates to a vibrating ram arrangement, for use in, for example, driving pilings into the ground.

BACKGROUND

EP 2 557 233 A1 discloses an implement with a hydraulic drive for underground construction work, which implement may be, in particular, a ramming device or drilling device.

In order to permit the implement to be adapted to the respective power requirements, a sensor for measuring the fluid pressure is arranged in a hydraulic circuit of the implement and is connected to an open-loop and closed-loop control unit. Both the displacement volume of the adjustable hydraulic motor and an internal combustion engine which is provided for rotating an adjustable hydraulic pump can be controlled by means of this open-loop and closed-loop control unit.

EP 2 557 233 A1 is concerned with the problem that during drilling or also vibration of ramming a maximum rotational speed or a predefined frequency range should not be departed from. At the start of such underground construction work the loading and therefore also the power requirement are still low so that only a small power level also has to be made available by the internal combustion engine. In order to cope with these requirements and, in particular, make available different power levels of the implement, a hydraulic transmission which is known per se is used, wherein the rotational speed of the internal combustion engine is also taken into account. Similar concepts are also described, for example, in DE 20 2007 014 676 A1, DE 27 00 803 A1, DE 2 236 134 and DE 38 06 194.

The present invention relates specifically to a vibrating ram arrangement according to the brochure "Müller-Vibratoren. Die perfekte Lösung zum Rammen and Ziehen [Müller Vibrators, the perfect solution for ramming and drawing] ", ThyssenKrupp GfT Bautechnik GmbH May 2011. The vibrator as a hydraulically driven machine is arranged above a vibration isolator here, for example on the hook of a crane, and is spatially separated from the hydraulic assembly. The hydraulic assembly with the hydraulic pump is connected to the vibrator via flexible hoses and is therefore isolated from the generation of the vibrations.

Owing to the very large mechanical loading on the vibrator, as a rule control electronics are dispensed with on the vibrator itself, wherein the operator control and adjustment of the vibrator is carried out via the hydraulic assembly. Even the arrangement of electronic sensors is problematic owing to the extreme mechanical loading and can lead to an increased risk of failure, for which reason the use of such sensors and other electronic devices such as servo drives is to be avoided as far as possible.

SUMMARY

In an embodiment of the present disclosure, a vibrating ram arrangement or assembly is disclosed. The vibrating ram assembly includes a hydraulic assembly as well as a vibrator that is spatially separated from the hydraulic assembly and is connected to the hydraulic assembly via hydraulic hoses. A controller is in operative communication with the hydraulic assembly. The hydraulic assembly has an internal combustion engine and a hydraulic pump, which pump is driven by the internal combustion engine. The vibrator has at least one rotatably mounted imbalance mass and at least one adjustable hydraulic motor with a variable displacement volume that drives the imbalance mass. Hydraulic fluid is conducted in a circuit through the hydraulic assembly, the hydraulic hoses, and the at least one hydraulic motor.

An object of the present disclosure is to provide a vibrating ram arrangement or assembly that permits efficient operation thereof, using simple and reliable components and techniques while being energy efficient, especially with a lower power requirement of the vibrator.

BRIEF DESCRIPTION OF THE DRAWINGS

The present disclosure is described in detail below with reference to the attached drawing figures, wherein.

DETAILED DESCRIPTION

Figure 1:
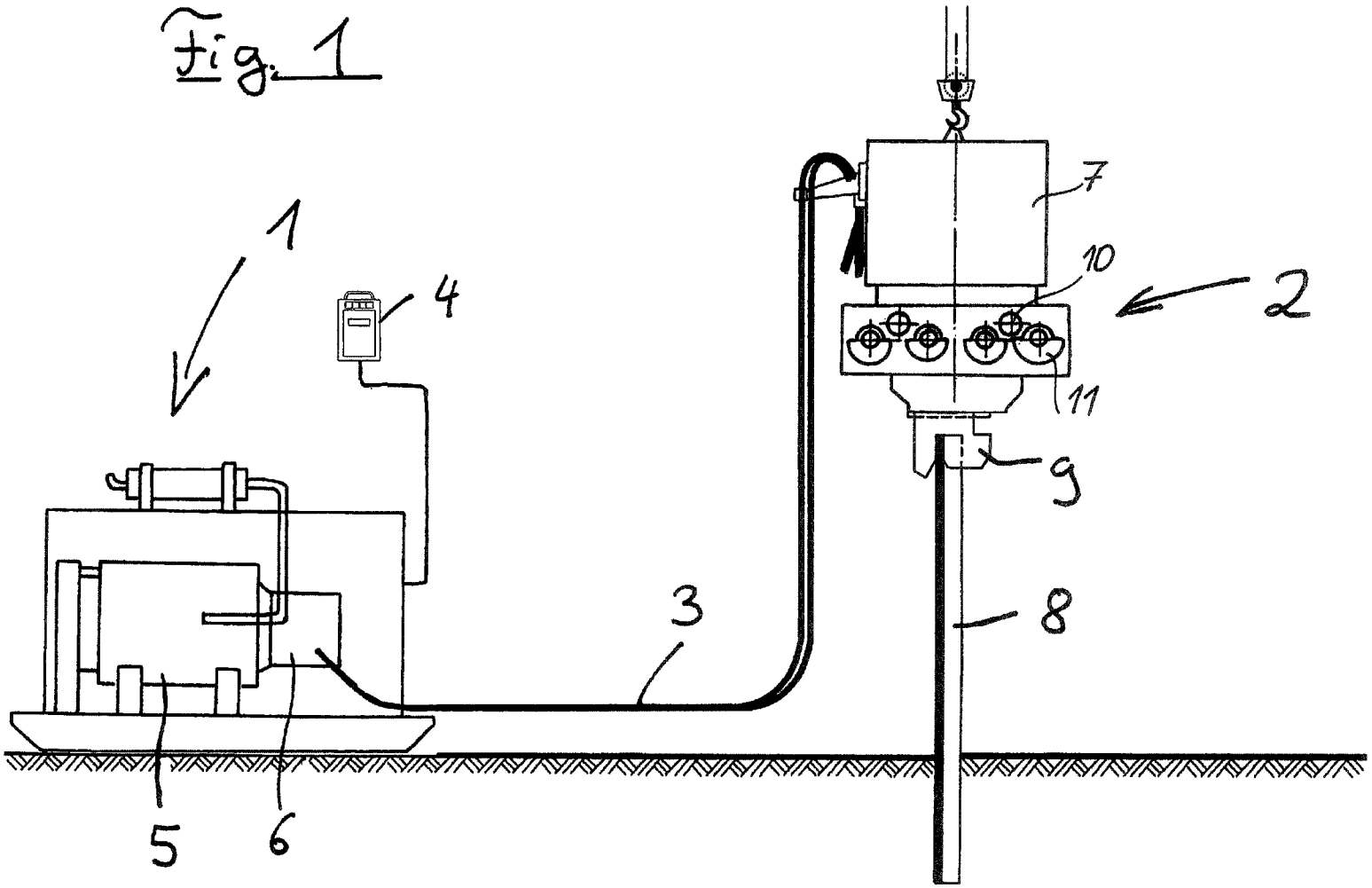
FIG. 1 is a schematic side view of a vibrating ram assembly in operation driving a piling into the ground.

Disclosed herein is a vibrating ram assembly having a hydraulic assembly as well as a vibrator that is spatially separated from the hydraulic assembly and is connected to the hydraulic assembly via hydraulic hoses. A controller is in operative communication with the hydraulic assembly. The hydraulic assembly has an internal combustion engine and a hydraulic pump, which pump is driven by the internal combustion engine. The vibrator has at least one rotatably mounted imbalance mass and at least one adjustable hydraulic motor with a variable displacement volume that drives the imbalance mass. Hydraulic fluid is conducted in a circuit through the hydraulic assembly, the hydraulic hoses, and the at least one hydraulic motor. The vibrator includes a device that is independent of the controller and is configured to adjust the displacement volume of the hydraulic motor as a function of a pressure within the circuit. A frequency sensor is connected to the controller and is configured to determine the frequency of the vibrator. The controller is configured to control the volume flow, conducted through the circuit, based on a signal received from the frequency sensor. In this context it is preferred to control the rotational speed of the internal combustion engine as a function of the signal of the frequency sensor.

According to the invention, in contrast to the prior art, the displacement volume of the adjustable hydraulic motor is not adjusted by means of a central controller but instead by means of a separate device for adjusting the displacement volume which automatically adjusts the displacement volume as a function of a pressure within the circuit. Accordingly, the device for adjusting the displacement volume is arranged on the vibrator, particularly preferably directly on the hydraulic motor of the vibrator, and is therefore also spatially separated from the controller which is assigned to the hydraulic assembly.

The device for adjusting the displacement volume can be connected, in particular, hydraulically to a feed line of the hydraulic motor. When there is a low power requirement, a comparatively low pressure is then projected.

In order to achieve as simple and reliable an embodiment as possible of the device for adjusting the displacement volume, the latter can have a hydraulic actuator element which is connected to the circuit. Such an actuator element can bring about, in particular, mechanical adjustment of the hydraulic motor, wherein the actuator element can be configured as a pressure cell or as a spring-loaded actuator cylinder. Adjustment of the displacement volume is furthermore also possible by means of a volume flow which is controlled by pressure valves.

Within the scope of the invention it is basically possible for the displacement volume to be adjusted continuously as a function of a pressure, in particular an overpressure in a feed line of the hydraulic motor. Since the displacement volume determines the quantity of oil for a stroke or a rotation of the hydraulic motor, a change in the displacement volume when there is a constant volume flow leads directly to a change in the rotational speed. Within the scope of the invention, such change in the rotational speed of the hydraulic motor is, however, determined by the frequency sensor which is connected to the controller. The controller is configured to change the volume flow in the circuit as a function of the frequency of the vibrator which usually corresponds to the rotational speed of the at least one hydraulic motor. For example, an increase in the displacement volume leads to a situation in which a relatively large quantity of hydraulic oil is required for a stroke or a rotation of the hydraulic motor, as a result of which the torque increases. In order then to keep the frequency of the vibrator constant, the rotational speed of the internal combustion engine can be correspondingly increased. If the hydraulic pump which is driven by the internal combustion engine is adjustable, the displacement volume of the hydraulic pump can additionally or alternatively also be changed.

In order to achieve a further simplification, the displacement volume of the hydraulic motor can be adjusted incrementally. If a predefined pressure value is then exceeded or undershot at a predefined point on the circuit to which the device for adjusting the displacement volume is connected, the hydraulic motor is switched over to another displacement volume. In particular, the hydraulic motor can be switchable in two increments, as a result of which a very simple structural configuration is made possible. Furthermore, such a simple configuration also permits the transmission of vibration between the device for adjusting the displacement volume and the adaptation of the volume flow by the controller to be avoided.

The vibrating ramming is based on the principle of placing the ground in a quasi-liquid state. This is achieved by vibrating the pile when it strikes the ground. The surface friction of the material which is to be driven is significantly reduced by the vibration and thus a fast penetration progress is made possible. The vibration frequency can be, for example between 10 Hz and 60 Hz, in particular between 30 Hz and 50 Hz.

However, the deeper the pile penetrates into the ground, the greater the resistance and the friction. The vibrator is, as it were, "held tight" by the pile and can therefore no longer vibrate freely. The necessary driving power to rotate the imbalance masses increases here.

Furthermore, during vibrating ramming, there is a particular feature that the penetration progress depends approximately on the square of the frequency of the vibrator. Therefore, if a sufficiently high frequency can no longer be maintained when the resistance is increased, further driving in is no longer possible.

Vibrating ram arrangements must therefore be configured that they maintain a predefined vibration frequency in the circuit even under the greatest permissible loads and therefore even when there is a maximum drop in pressure. However, a correspondingly large configuration of the vibrating ram arrangement has the effect, on the other hand, that the latter is over dimensioned in the case of relatively lower power requirements, that is to say, in particular, at the start of the driving-in process.

The invention also relates to a method for operating the described vibrating ram arrangement, wherein in a first operating mode with a low power requirement of the vibrator, in particular at a predefined frequency, the hydraulic motor is operated with a first displacement volume $V_1$, and the internal combustion engine is operated with a first rotational speed $D_1$ of the internal combustion engine, wherein a first pressure $p_1$ occurs in the circuit, wherein increasing the power requirement of the vibrator brings about a change in the pressure in the circuit, in response to which the device for automatically adjusting the displacement volume adjusts the hydraulic motor in order to increase the torque to a relatively high displacement volume $S_2$ and an increased second rotational speed $V_2$ of the internal combustion engine is set. The increased second rotational speed of the internal combustion engine is set by virtue of the fact that the frequency of the vibrator is determined with the frequency sensor, wherein the controller changes the rotational speed of the internal combustion engine in order to keep the frequency constant or at least in a predefined frequency range.

As a result of the described measures at the start of a driving-in process for vibrating ramming the internal combustion engine of the hydraulic assembly is operated with a significantly reduced power, which results in relatively low noise generation and also relatively low consumption. The internal combustion engine of the vibrating ram arrangement according to the invention usually uses diesel as fuel.

The present disclosure will be discussed in further detail below with reference to the attached drawing figures that illustrate one exemplary embodiment.

FIG. 1 shows a vibrating ram arrangement which comprises a hydraulic assembly 1 and a vibrator 2 which are spatially separated from one another by means of flexible hydraulic hoses 3, and therefore arranged in a mechanically isolated fashion. The hydraulic assembly 1 has a hydraulic controller S (see FIG. 2), wherein the operator control of the controller S can be carried out by means of a remote control 4 which communicates with the controller S by cable or in a cableless fashion. The hydraulic assembly 1 comprises an internal combustion engine 5 which is run on diesel, as well as a hydraulic pump 6 which is driven by the internal combustion engine 5.

In the illustrated exemplary embodiment, the vibrator 2 is supported by means of a vibration isolator 7 which is suspended from a crane. A pile 8 which is to be driven in is clamped in a hydraulic collet chuck 9 on the underside of the vibrator 2.

In the illustrated exemplary embodiment, two hydraulic motors 10 are provided which each drive imbalance masses 11 which rotate in opposite directions. As a result of the eccentrically mounted imbalance masses 11, the vibrator 2 is made to vibrate in a vertical direction, as a result of which a movement of the imbalance masses 11 in opposite directions increases the moments in the horizontal direction. The imbalance masses 11 are driven by means of gear wheels (not illustrated).

The vibrating ramming occurs in practice at a predefined frequency or in a predefined frequency range of the vibrator 2.

At the start of a driving-in process of the pile 8, only comparatively low power is required at the vibrator 2 because the friction between the pile 8 and the underlying surface is still small. As the penetration depth of the pile 8 increases, the resistance increases, with the result that a relatively high power level has to be made available to maintain the predefined frequency or the predefined frequency range of the vibrator 2. In particular, the hydraulic assembly 1 has to be configured for very large power levels at the end of a driving-in process.

At the start of the driving-in process, the vibrating ram arrangement is therefore, as it were, over-dimensioned. In order to counteract efficiency losses resulting from this, the configuration of a hydraulic circuit illustrated in FIG. 2 is provided, as a result of which the hydraulic motors 10 or at least one hydraulic motor 10 which is provided to drive the imbalance masses 11 can be adjusted with a variable displacement volume.

Figure 2:
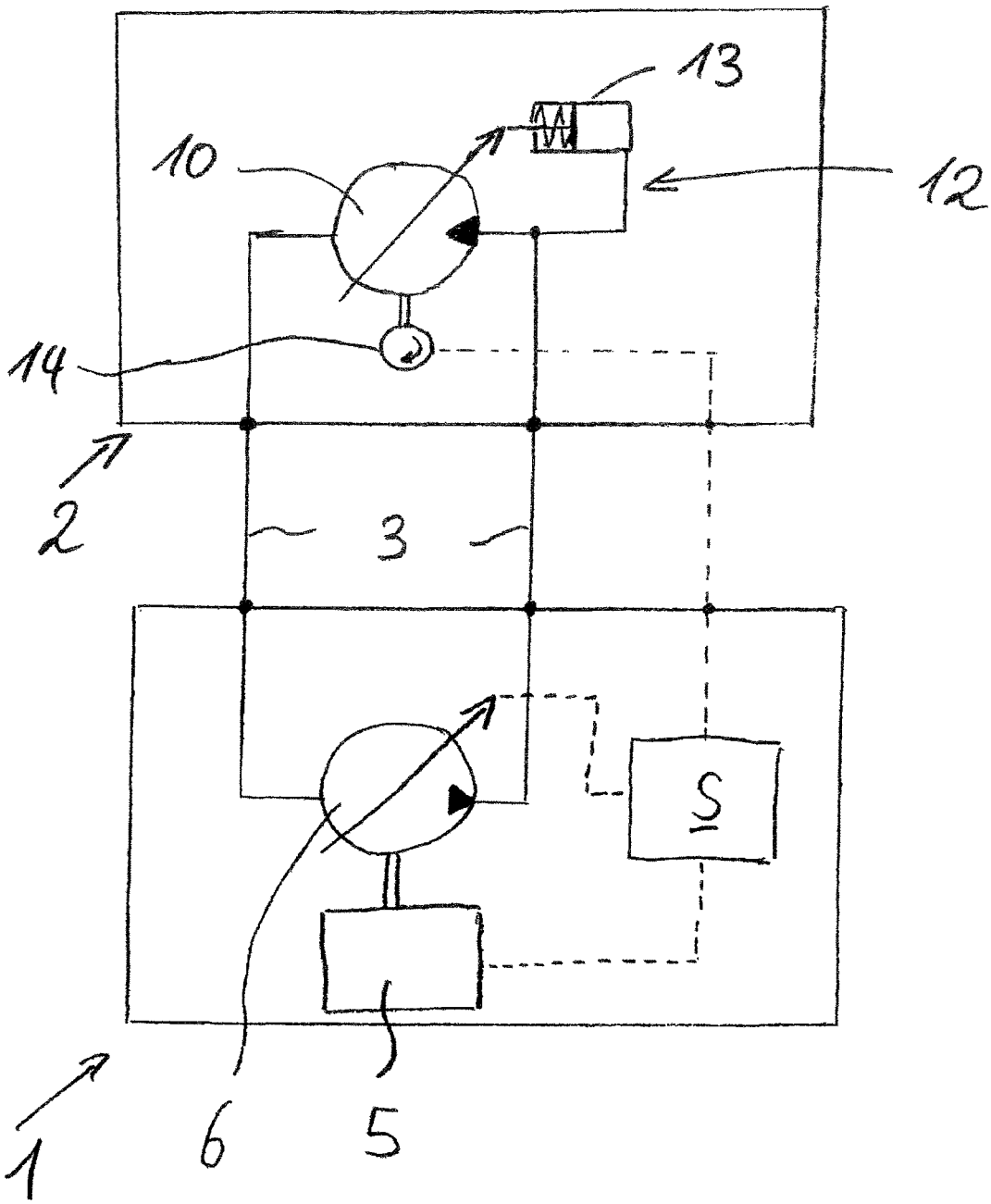
FIG. 2 is a simplified schematic hydraulic circuit diagram of the vibrating ram assembly of FIG. 1.

According to the invention, for this purpose according to FIG. 2 a device 12 which is mounted directly on the hydraulic motor 10 and has the purpose of automatically adjusting the displacement volume as a function of a pressure is arranged inside the circuit.

According to the exemplary embodiment, the device 12 is connected to a feed line of the hydraulic motor 10 with a branch, wherein the device 12 has a hydraulic actuator element 13 in the form of a spring-loaded lifting cylinder. A change in pressure at the feed line of the hydraulic motor 10 is converted by the hydraulic actuator element 13 into a mechanical reciprocating movement with which the hydraulic motor 10 is adjusted directly. According to the invention, a connection to the controller S can therefore be dispensed with for the adjustment of the displacement volume of the hydraulic motor 10.

The device 12 is configured in a particularly simple way and converts a hydraulic pressure directly into a mechanical movement for adjusting the hydraulic motor 10, with the result that this arrangement operates reliably even in the case of extreme mechanical load on the vibrator 2.

If, for example, the vibrator 2 is operated in a first operating mode with a low power requirement at a predefined frequency, the hydraulic motor 10 has a first displacement volume $V_1$, wherein the volume flow which is necessary to maintain the predefined frequency is made available by the hydraulic pump 6 which is driven by the internal combustion engine 5.

During the increasing of the power requirement of the vibrator 2, an increase in pressure from a first pressure $p_1$ to a second pressure $p_2$ is observed at the feed line of the vibrator 2, after which at a predefined threshold of the pressure, the hydraulic actuator element 13 adjusts the displacement volume of the hydraulic motor 10 to a relatively high second displacement volume $V_2$. The torque of the hydraulic motor 10 is increased by the increasing of the displacement volume to the second value $V_2$, with the result that said hydraulic motor 10 can cope with this relatively high power requirement of the vibrator 2.

However, at the same time, the hydraulic motor 10 requires a relatively large amount of hydraulic fluid for rotation or for a stroke. In order, in this context, to be able to keep the frequency of the vibrator 2 a predefined value or in a predefined frequency range, the volume flow of hydraulic fluid in the circuit therefore has to be changed, that is to say increased here, with the adjustment of the displacement volume. In order to permit such a change, a frequency sensor 14 for determining the frequency of the vibrator 2 is connected to the controller S.

In order to determine the frequency by means of the frequency sensor 14, an electronic device is not absolutely necessary on the vibrator 2. For example, a pressure signal which is modulated by means of the frequency of the vibrator 2 can be tapped at the vibrator 2 and then passed on hydraulically to the hydraulic assembly 1 via an assigned hydraulic hose. The conversion into an electronic signal can then be carried out in the hydraulic assembly 1.

The rotational speed of the internal combustion engine can be changed with the controller S in order to compensate for changes in the frequency of the vibrator 2. Additionally or alternatively, the hydraulic pump 6 can also have a variable displacement volume, wherein the volume flow is then increased also or exclusively by adjustment of the hydraulic pump 6.

Within the scope of the invention it is essential to the invention that the changing of the volume flow, on the one hand, and the adjustment of the displacement volume of the at least one hydraulic motor 10, on the other, take place independently of one another with the result that there is no need for any common control process which has to be co-ordinated. Within the scope of the invention the adjustment of the displacement volume of the hydraulic motor 10 by the assigned device 12 is automatic, as a result of which a lower frequency of the vibrator 2 would result without further control of the volume flow. Since the frequency of the vibrator 2 is, however, monitored separately and adjusted by means of the controller S, the volume flow is compensated by the separate controller S by adjusting the displacement volume of the hydraulic pump 6 and/or by changing the rotational speed of the internal combustion engine.

The invention claimed is:

1. A vibrating ram assembly, comprising:

a hydraulic assembly having both of a hydraulic pump configured to pump hydraulic fluid therefrom, and an internal combustion engine operatively coupled to said hydraulic pump and configured to drive said pump;

a vibrator spatially separated from the hydraulic assembly and having at least one rotatably mounted imbalance mass configured to create vibratory motion, and at least one adjustable hydraulic motor operatively coupled to said at least one imbalance mass and configured to drive said imbalance mass by a variable displacement volume of hydraulic fluid pumped through said hydraulic motor;

a plurality of hydraulic hoses coupled at a first end to said hydraulic assembly and at a second end to said vibrator and configured to hydraulically connect said hydraulic assembly to said vibrator to create a hydraulic circuit through which hydraulic fluid may be pumped from said hydraulic assembly, through said hydraulic hoses, and through said at least one hydraulic motor of said vibrator to drive said imbalance mass;

a frequency sensor in operative communication with said vibrator and configured to determine a vibrational frequency thereof;

a controller in operative communication with both of said frequency sensor and said hydraulic assembly, and configured to control a flow volume through said hydraulic circuit based on a signal received from said frequency sensor; and a displacement volume adjustment device in fluid communication with said hydraulic circuit and disposed on and coupled to said vibrator and configured to automatically adjust a displacement volume of the hydraulic motor responsive to pressure within the hydraulic circuit.

2. The vibrating ram assembly of claim 1, wherein said displacement volume adjustment device is hydraulically connected to a hydraulic feed line of said hydraulic motor.

3. The vibrating ram assembly of claim 1, wherein said displacement volume adjustment device includes a hydraulic actuator that is hydraulically connected to the hydraulic circuit.

4. The vibrating ram assembly of claim 1, wherein the displacement volume of said hydraulic motor may be incrementally adjusted.

5. The vibrating ram assembly of claim 1, wherein said controller is configured to compensate for changes in the frequency of the vibrator, by a change in a rotational speed of said internal combustion engine.

6. The vibrating ram assembly of claim 1, wherein said hydraulic pump of said hydraulic assembly has a variable displacement volume.

7. A method for operating a vibrating ram assembly, comprising:

providing a vibrating ram assembly as described in claim 1;

when the vibrator has a low power requirement, operating both the hydraulic motor of the vibrator at a first displacement volume ($V_1$), and the internal combustion engine of the hydraulic assembly at a first rotational speed ($D_1$), to define a first operating mode in which the hydraulic circuit is at a first pressure ($p_1$);

when the vibrator has an increased power requirement above the low power requirement, increasing the pressure in the hydraulic circuit to a second pressure ($p_2$) higher than the first pressure ($p_1$);

by the displacement volume adjustment device, increasing the displacement volume of the vibrator's hydraulic motor to a second displacement volume ($V_2$) above the first displacement volume ($V_1$), so as to increase an operating torque of the hydraulic motor;

increasing the rotational speed of the internal combustion engine to a second rotational speed ($D_2$).

8. The method for operating a vibrating ram assembly of claim 7, further comprising:

determining, by the frequency sensor, the vibratory frequency of the vibrator;

setting the value of the increased second rotational speed ($D_2$) of the internal combustion engine based on the determined frequency of the vibrator; and adjusting, by the controller, the rotational speed of the internal combustion engine so as to maintain the frequency of the vibrator at one of a constant frequency or within a predefined frequency range.

9. The method of claim 7 comprising adjusting the displacement volume of the hydraulic motor incrementally.

10. The method of claim 7 wherein increasing the displacement volume of the vibrator's hydraulic motor is performed responsive only to increasing the pressure in the hydraulic circuit.

11. The vibrating ram assembly of claim 1 wherein the displacement volume adjustment device is spaced apart from the controller.

12. The vibrating ram assembly of claim 1 wherein the displacement volume adjustment device is disposed directly on the at least one adjustable hydraulic motor of the vibrator.

13. The vibrating ram assembly of claim 3 wherein the hydraulic actuator is configured as a pressure cell.

14. The vibrating ram assembly of claim 1 wherein the displacement volume adjustment device is hydraulically connected to a hydraulic feed line of the at least one hydraulic motor, wherein the displacement volume adjustment device includes a hydraulic actuator that is hydraulically connected to the hydraulic circuit, wherein a change in pressure at the hydraulic feed line is converted by the hydraulic actuator into a mechanical reciprocating movement with which the at least one hydraulic motor is adjusted directly.

15. The vibrating ram assembly of claim 1, wherein the displacement volume adjustment device is responsive only to pressure within the hydraulic circuit.

* * * * *